US009039398B2

(12) United States Patent
Schepp et al.

(10) Patent No.: US 9,039,398 B2
(45) Date of Patent: May 26, 2015

(54) INTERNAL GEAR PUMP HAVING A LUBRICANT FEED FROM THE SUCTION REGION

(75) Inventors: Rene Schepp, Waiblingen (DE); Kornelius Loew, Schwaigern (DE)

(73) Assignee: Robert Bosch GmbH, Stuttgart, DE (US)

( * ) Notice: Subject to any disclaimer, the term of this patent is extended or adjusted under 35 U.S.C. 154(b) by 37 days.

(21) Appl. No.: 13/989,959

(22) PCT Filed: Nov. 24, 2011

(86) PCT No.: PCT/EP2011/070949

§ 371 (c)(1), (2), (4) Date: Aug. 9, 2013

(87) PCT Pub. No.: WO2012/072492

PCT Pub. Date: Jun. 7, 2012

(65) Prior Publication Data

US 2013/0330223 A1 Dec. 12, 2013

(30) Foreign Application Priority Data

Nov. 30, 2010 (DE) ..... 10 2010 062 219

(51) Int. Cl.

| | |
|---|---|
| ***F03C 2/00*** | (2006.01) |
| ***F03C 4/00*** | (2006.01) |
| ***F04C 2/00*** | (2006.01) |
| ***F04C 15/00*** | (2006.01) |
| ***F04C 18/10*** | (2006.01) |
| ***F01C 1/10*** | (2006.01) |
| ***F04C 2/10*** | (2006.01) |

(52) U.S. Cl.

CPC ..... *F04C 15/0088* (2013.01); *F04C 15/0023* (2013.01); *F04C 18/103* (2013.01); *F01C 1/102* (2013.01); *F04C 15/0026* (2013.01); *F04C 2/101* (2013.01)

(58) Field of Classification Search

USPC ..... 418/71, 126–129, 166, 170–171, 418/131–132

See application file for complete search history.

(56) References Cited

U.S. PATENT DOCUMENTS

| | | | | |
|---|---|---|---|---|
| 4,132,515 | A * | 1/1979 | Kruger | 418/170 |
| 6,402,488 | B2 * | 6/2002 | Watanabe et al. | 418/171 |

(Continued)

FOREIGN PATENT DOCUMENTS

| | | | |
|---|---|---|---|
| DE | 1 528 947 | A1 | 9/1969 |
| DE | 1 528 946 | A1 | 10/1969 |
| DE | 1 553 193 | A1 | 1/1971 |
| DE | 196 13 833 | A1 | 10/1997 |

OTHER PUBLICATIONS

International Search Report corresponding to PCT Application No. PCT/EP2011/070949, mailed Apr. 29, 2013 (German and English language document) (7 pages).

*Primary Examiner* — Theresa Trieu

(74) *Attorney, Agent, or Firm* — Maginot, Moore & Beck LLP

(57) ABSTRACT

An internal gear pump includes a ring gear and a pinion configured to mesh with the ring gear. The ring gear and pinion delimit a pump chamber extending from a suction region to a pressure region. The internal gear pump also includes an axial disk arranged on front faces of the ring gear and the pinion and includes a lubricant feed from the suction region between the axial disk and the ring gear and pinion. The lubricant feed includes a lubricant channel which passes through the axial disk. A wedge gap is delimited between the axial disk and the ring gear and pinion. The wedge gap communicates with the suction region and, when the ring gear and the pinion are driven in rotation, a lubricating film forms between the axial disk and the ring gear and pinion.

3 Claims, 2 Drawing Sheets

(56) References Cited

U.S. PATENT DOCUMENTS 6,450,792 B1 * 9/2002 Eisenbacher et al. ..... 418/170
6,749,272 B2 * 6/2004 Uchiyama et al. ..... 418/171
6,905,321 B2 * 6/2005 Uchiyama et al. ..... 418/171
2003/0031578 A1 2/2003 Uchiyama et al.
2010/0247363 A1 * 9/2010 Kaeferstein et al. ..... 418/170

* cited by examiner

INTERNAL GEAR PUMP HAVING A LUBRICANT FEED FROM THE SUCTION REGION

This application is a 35 U.S.C. §371 National Stage Application of PCT/EP2011/070949, filed on Nov. 24, 2011, which claims the benefit of priority to Serial No. DE 10 2010 062 219.2, filed on Nov. 30, 2010 in Germany, the disclosures of which are incorporated herein by reference in their entirety.

The disclosure relates to an internal gear pump having the features described below.

BACKGROUND

An internal gear pump is known from the patent DE 196 13 833 B4. It comprises two gear wheels, namely a ring gear, which may also be referred to as an internally toothed wheel, and an externally toothed wheel which for the sake of a clear distinction will be referred to hereinafter as a pinion. The ring gear and the pinion are together referred to as gear wheels. The pinion is arranged eccentrically in the ring gear, so that the two gear wheels mesh with one another in a circumferential section. The two gear wheels delimit between them a crescent-shaped pump chamber which extends in the circumferential direction from a suction region to a pressure region of the internal gear pump. The pump chamber extends outside the circumferential section in which the two gears mesh with one another. The pump chamber of such an internal gear pump is sometimes referred to as a displacement chamber or simply as an intermediate or free space. The ring gear delimits the pump chamber on the outside while the pinion delimits it on the inside. The suction region may also be understood as the inlet and the pressure region as the outlet of the internal gear pump.

In order to delimit the pump chamber laterally, the known internal gear pump has on each front face of the two gear wheels a so-called axial disk which bears against the front faces of the gear wheels with its inner side oriented towards the gear wheels and is subjected to pressure on its outer side oriented away from the gear wheels. The inner side and the outer side of the axial disk are its front faces (!). The axial disks are intended to seal against the gear wheels of the internal gear pump and the stationary axial disks are intended to have low friction with respect to the rotating gear wheels. The axial disks do not seal hermetically; leakage occurs between the axial disks and the gear wheels. The aim is to find a good compromise between a good sealing effect on the one hand and low friction on the other between the axial disks and the gear wheels in each case.

SUMMARY

The internal gear pump according to the disclosure having the features described below includes at least one axial disk on one front face of the gear wheels—that is, of the ring gear and the pinion—of the internal gear pump, which axial disk is subjected to pressure on an outer side and is pressed against the front faces of the gear wheels of the internal gear pump with its inner side. The internal gear pump according to the disclosure preferably has two axial disks, namely one axial disk on each front face of the gear wheels, the inner sides of which axial disks are pressed, through the application of pressure to their outer sides, against the front faces of the gear wheels of the internal gear pump. The disclosure provides for a lubricant feed from the suction region of the internal gear pump between the axial disk/s and the gear wheels of the internal gear pump. When the internal gear pump is operated, the rotating gear wheels of the internal gear pump, that is, the ring gear and the pinion, convey fluid from the suction region, that is, from the inlet of the internal gear pump, between the rotating gear wheels and the stationary axial disk/s. The fluid conveyed between the gear wheels and the axial disk/s as a film on the front faces of the gear wheels of the internal gear pump is the fluid which is delivered by the internal gear pump; it is used as a lubricant. The process is comparable to lubrication of a hydrodynamic axial plain bearing. The disclosure improves lubrication between the stationary axial disk/s, which is/are subjected to pressure on their outer sides and thereby are pressed with their inner sides against the rotating gear wheels of the internal gear pump, and the rotating gear wheels. Friction between the gear wheels and the axial disk/s, and wear, are reduced, service life is increased and efficiency of the internal gear pump is improved. During operation of the internal gear pump, the disclosure avoids mixed friction or even dry friction between the rotating gear wheels of the internal gear pump and the stationary axial disk/s pressed against the gear wheels from the outside, or at least the disclosure reduces the danger of such mixed or dry friction, which increases friction and wear while reducing efficiency and service life. Only when the internal gear pump is stationary and starting can mixed or dry friction between the gear wheels and the axial disk/s occur, although the disclosure improves and accelerates a build-up of lubricant between the gear wheels and the axial disks during startup of the internal gear pump.

The internal gear pump according to the disclosure may be either a so-called sickle pump with a sickle—that is, a usually sickle-shaped body in the pump chamber between the ring gear and the pinion, along the inner face of which sickle-shaped body tooth heads of the pinion slide while tooth heads of the ring gear slide along its outer face—or a so-called ring gear pump without such a sickle. The outer side/s of the axial disk/s may be subjected to pressurized fluid from the pressure region, that is, from the outlet of the internal gear pump, as known from the prior art, in order to press the axial disk/s against the gear wheels of the internal gear pump.

The subject matter described below comprises advantageous configurations and developments of the disclosure specified in the description below.

A configuration of the disclosure provides a lubricant channel in the axial disk/s as a lubricant feed which communicates with the suction region of the internal gear pump and opens, on the inner side of the axial disk/s, onto a front face of the ring gear and/or of the pinion. The lubricant channel may divide towards both gear wheels, or two (or more) lubricant channels are provided.

A development of this configuration of the disclosure provides that the lubricant channel passes through the axial disk/s from the outside to the inside; for example, one or more bores form the lubricant channel or channels through the axial disk/s.

The description below provides for the formation of a kind of wedge gap between the axial disk/s and one or both gear wheels of the internal gear pump, which wedge gap, starting from the suction region, narrows in a direction of rotation of the gear wheels and therefore in a delivery direction of the internal gear pump. In order to form the wedge gap, the axial disk/s has/have an oblique face which in the suction region of the internal gear pump is at a distance from the gear wheels of the internal gear pump, which distance diminishes in the direction of rotation of the gear wheels and therefore in the delivery direction of the internal gear pump. The oblique face may be, but need not be, a flat surface. In its wide region the wedge gap communicates with the suction region of the internal gear pump, so that when the gear wheels of the internal gear pump rotate during operation of the pump they deliver fluid, through the drag effect, from the suction region into the narrowing wedge gap and therefore between the front faces of the rotating gear wheels and the inner sides of the axial disk/s. The wedge gap between the oblique face of the axial disk/s and the gear wheels of the internal gear pump forms a lubricant feed and may be implemented alone or together with one or more lubricant channels in the axial disk/s.

BRIEF DESCRIPTION OF THE DRAWINGS

The disclosure is explained in more detail below with reference to an embodiment represented in the drawing, in which.

DETAILED DESCRIPTION

Figure 1:
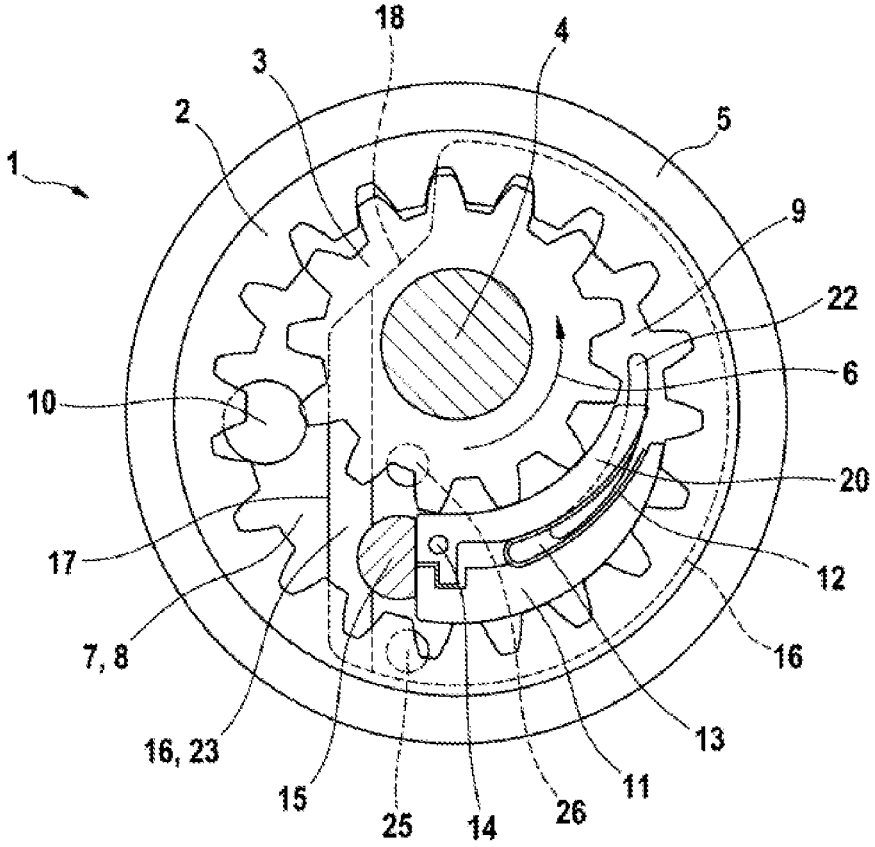
FIG. 1 shows a front view of an internal gear pump according to the disclosure.

The internal gear pump 1 according to the disclosure represented in FIG. 1 comprises a ring gear 2, that is, and internally toothed wheel, and an externally toothed wheel referred to here as the pinion 3. The pinion 3 is arranged non-rotatably on a shaft 4. The ring gear 2 is supported rotatably in a plain bearing ring 5 which is press-fitted into a pump housing (not shown). The pinion 3 and the ring gear 2 are of equal width and have parallel axes, and are arranged eccentrically with respect to one another in such a way that the pinion 3 and the ring gear 2 mesh with one another in a circumferential section. When the shaft 4 is driven in rotation the pinion 3 is driven in rotation and in turn drives the ring gear 2 in rotation, a direction of rotation being indicated by the arrow 6. The pinion 3 and the ring gear 2 are also referred to jointly as gear wheels 2, 3 of the internal gear pump 1.

In a circumferential section in which the pinion 3 and the ring gear 2 do not mesh with one another they delimit between them a crescent-shaped pump chamber 7, the ring gear 2 delimiting the pump chamber 7 on the outside and the pinion 3 delimiting the pump chamber 7 on the inside. The pump chamber 7 extends from a suction region 8 to a pressure region 9. A bore opens into the suction region 8 as the inlet 10. A sickle-shaped body, referred to here as the sickle 11, which separates the suction region 8 from the pressure region 9, is arranged in the pump chamber 7. The sickle 11 has the same width as the pinion 3 and the ring gear 2; tooth heads of the ring gear 2 slide along its cylindrical outer surface and tooth heads of the pinion 3 along its hollow-cylindrical inner surface. The sickle 11 encloses in tooth gaps of the ring gear 2 and of the pinion 3 fluid volumes which are delivered by the rotating pinion 3 and the rotating ring gear 2 from the suction side 8 to the pressure side 9 during operation of the internal gear pump 1. In the exemplary embodiment of the disclosure represented, the sickle 11 is a two-part body the two parts of which are articulated to one another and are pressed, by a leg spring 12 located between them, outwards against the tooth heads of the ring gear 2 and inwards against the tooth heads of the pinion 3. In addition, an intermediate space 13 between the inner and outer parts of the sickle 11 communicates with the pressure region 9, so that the two parts of the sickle 11 are pressed outwardly against the tooth heads of the ring gear 2 and inwardly against the tooth heads of the pinion 3. A pin 14 holds the sickle 11, which is supported in the circumferential direction, against the pressurization from the pressure side 9, by a stop pin 15.

Figure 2:
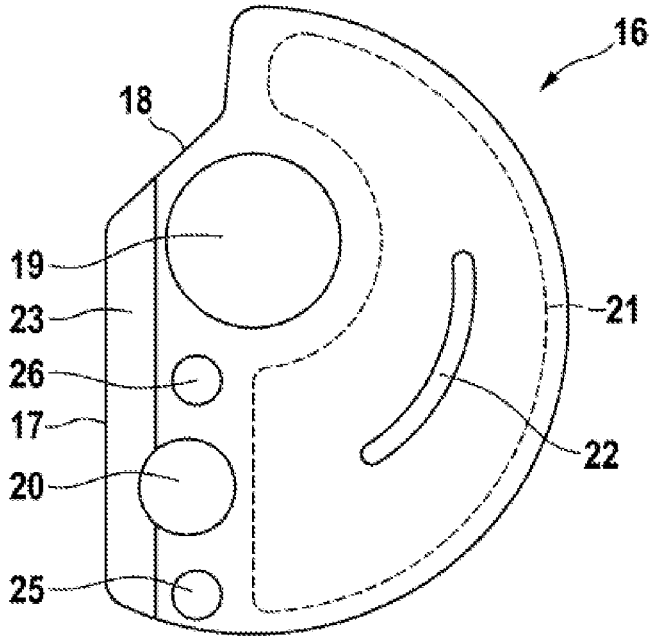
FIG. 2 is a view of the inner side of an axial disk of the internal gear pump from FIG. 1.

Axial disks 16, one of which is represented in FIG. 2, are arranged on each side of the pinion 3 and the ring gear 2. The axial disks 16 are arranged in a fixed manner in the pump housing (not shown); they do not rotate with the pinion 3 and the ring gear 2. The axial disks 16 bear with their inner sides against front faces of the pinion 3 and the ring gear 2. The axial disks 16 delimit the pump chamber 7 laterally. The inner and outer sides of the axial disks 16 are front faces of the axial disks 16.

In the exemplary embodiment of the disclosure represented, the axial disks 16 have approximately the shape of segments of a circle, that is, are delimited by an arc and a chord of a circle, the axial disks 16 being larger than a semicircle. An edge 17 of the axial disks 16 extending in the direction of a chord of a circle ends with a notch 18 in the form of an oblique step. The shape of the axial disks 16 is not mandatory for the disclosure. The axial disks 16 have a through-bore 19 for the shaft 4 of the internal gear pump 1 and a bore 20 for the stop pin 15 for the sickle 11.

In order that the axial disks 16 seal to the pinion 3 and to the ring gear 2, their outer sides are subjected to pressure (FIG. 2 shows the inner side of the one axial disk 16!). To effect the pressurization, the outer sides of the axial disks 16 have a so-called pressure field 21, which is indicated with a broken line in FIG. 2 and can be seen in the sectional representation of FIG. 3. The pressure field 21 is a depression in the outer side of the axial disk 16, being, for example, crescent-shaped. The pressure field 21 may also be formed in the pump housing (not shown). In the exemplary embodiment, the pressure field 21 communicates with the pressure region 9 of the pump chamber 7 via an approximately quadrant-shaped slot 22 passing transversely through the axial disk 16.

Figure 3:
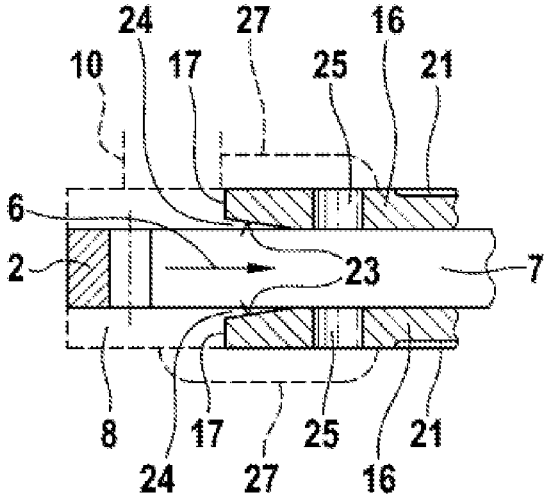
FIG. 3 is a sectional representation of a ring gear and of the axial disks of the internal gear pump from FIG. 1.

The axial disks 16 of the internal gear pump 1 according to the disclosure have, along the edge 17 of the axial disks 16 extending in the direction of the chord of a circle, an oblique face 23 on the inner sides of the axial disks 16. The oblique face 23 extends on a strip parallel to the edge 17 of the axial disks 16. The oblique faces 23 on the inner sides of the axial disks 16 which bear against the pinion 3 and the ring gear 2 delimit wedge gaps 24 between them and the front faces of the pinion 3 and the ring gear 2. The wedge gaps 24 can be seen in FIG. 3, which shows an axial section of the ring gear 2 and a section of the axial disks 16, which is parallel thereto and offset outwardly level with the teeth of the ring gear 2. All the other parts are omitted from FIG. 3 for clarity. The wedge gaps 24 between the axial disks 16 and the ring gear 2 are also present between the axial disks 16 and the pinion 3. The wedge gaps 24 narrow in the direction of rotation 6 of the ring gear 2 and the pinion 3. The wedge gaps 24 are open to the suction region 8, indicated with broken lines in FIG. 3. Also indicated with broken lines in FIG. 3 is the bore which opens into the suction region 8 of the pump chamber 7 and forms the inlet 10 of the internal gear pump 1.

During operation of the internal gear pump 1, the wedge gaps 24 effect or improve hydrodynamic lubrication between the axial disks 16 and the pinion 3 and the ring gear 2: by their rotation, the pinion 3 and the ring gear 2 convey from the suction region 8 fluid adhering to their front faces as a lubricating film between them and the axial disks 16. The wedge gaps 24, formed by the oblique faces 23 of the axial disks 16 between them and the pinion 3 and the ring gear 2, improve the formation of the lubricating film. The build-up of the lubricating film between the axial disks 16, which are pressed through pressurization from outside against the pinion 3 and the ring gear 2, is comparable to the build-up of a lubricating film of a hydrodynamic axial plain bearing. The lubricating film reduces friction and wear.

Level with the teeth of the pinion 3 and of the ring gear 2 when viewed radially, and level with the bore 20 for the stop pin 15 when viewed in the circumferential direction, the axial disks 16 of the internal gear pump 1 according to the disclosure have bores 25, 26 which pass transversely through the axial disks 16 of the internal gear pump 1 according to the disclosure. In other words, the bores 25, 26 are arranged close to the edge 17 of the axial disks 16 at which the pinion 3 and the ring gear 2 move in between the axial disks 16 when driven in rotation. As indicated with broken lines in FIG. 3, the bores 25, 26 in the axial disks 16 communicate through channels 27 in side walls of the internal gear pump 1 with the suction region 8 of the pump chamber 7 and with the inlet 10 of the internal gear pump 1. Through the bores 25, 26 fluid from the inlet 10 and the suction region 8 of the internal gear pump 1 reaches the front faces of the pinion 3 and of the ring gear 2 and is conveyed between the axial disks 16 located outside and the pinion 3 and the ring gear 2 when the pinion 3 and the ring gear 2 are driven in rotation. Hydrodynamic lubrication of the pinion 3 and of the ring gear 2 between the axial disks 16 is therefore also effected through the bores 25, 26. The bores 25, 26 may be provided additionally to or instead of the oblique faces 23. In order to supply fluid as a lubricating film in other places between the axial disks 16 and the pinion 3 and the ring gear 2, it is possible to provide the bores 25, 26 or additional bores at other locations of the axial disks 16 (not shown).

Like the bores 25, 26, the wedge gaps 24 form a lubricant feed between the axial disks 16 and the pinion 3 and the ring gear 2, although the bores 25, 26 in the axial disks 16 may also be understood more generally as lubricant channels.

The invention claimed is:

1. An internal gear pump, comprising:

a ring gear;

a pinion arranged eccentrically in the ring gear and configured to mesh with the ring gear in a circumferential section;

a pump chamber delimited between the ring gear on an outside and the pinion on an inside, the pump chamber extending in a circumferential direction from a suction region to a pressure region outside the circumferential section in which the ring gear and the pinion mesh;

at least one axial disk arranged on a front face of the ring gear and a front face of the pinion and configured to bear against the front faces of the ring gear and of the pinion, the at least one axial disk having an inner side oriented toward the ring gear and the pinion and an opposite outer side oriented away from the ring gear and the pinion, the outer side being configured to be subjected to pressure and the inner side being configured to delimit the pump chamber on one side; and a lubricant feed from the suction region between the at least one axial disk and at least one of the ring gear and the pinion, wherein:

the lubricant feed includes a lubricant channel in the at least one axial disk, the lubricant channel is configured to communicate with the suction region of the internal gear pump and is configured to open, on the inner side of the at least one axial disk, onto the front face of at least one of the ring gear and the pinion, and the lubricant channel is configured to pass through the at least one axial disk from the outer side to the inner side.

2. An internal gear pump, comprising:

a ring gear;

a pinion arranged eccentrically in the ring gear and configured to mesh with the ring gear in a circumferential section;

a pump chamber delimited between the ring gear on an outside and the pinion on an inside, the pump chamber extending in a circumferential direction from a suction region to a pressure region outside the circumferential section in which the ring gear and the pinion mesh;

at least one axial disk arranged on a front face of the ring gear and a front face of the pinion and configured to bear against the front faces of the ring gear and of the pinion, the at least one axial disk configured to be subjected to pressure on an outer side oriented away from the ring gear and the pinion and configured to delimit the pump chamber on one side; and a lubricant feed from the suction region between the at least one axial disk and at least one of the ring gear and the pinion, wherein:

the at least one axial disk has an oblique face on an inner side oriented towards the ring gear and the pinion, the oblique face is at a distance from at least one of the ring gear and the pinion in the suction region of the internal gear pump, is configured to converge with at least one of the ring gear and the pinion in a delivery direction of the internal gear pump, and is configured to delimit a wedge gap between the at least one axial disk and at least one of the ring gear and the pinion, and the wedge gap is configured to narrow in the delivery direction, is configured to communicate with the suction region, and is configured to form the lubricant feed.

3. The internal gear pump as claimed in claim 2, wherein:

the lubricant feed includes a lubricant channel in the at least one axial disk, and the lubricant channel is configured to communicate with the suction region of the internal gear pump and is configured to open, on an inner side of the at least one axial disk, onto the front face of at least one of the ring gear and the pinion.

* * * * *